US007901614B2

(12) United States Patent
Breister et al.

(10) Patent No.: US 7,901,614 B2
(45) Date of Patent: Mar. 8, 2011

(54) METHODS AND APPARATUS FOR MELTBLOWING OF POLYMERIC MATERIAL UTILIZING FLUID FLOW FROM AN AUXILIARY MANIFOLD

(75) Inventors: James C. Breister, Oakdale, MN (US); Andrew W. Chen, Woodbury, MN (US); William P. Klinzing, Woodbury, MN (US); Patrick J. Sager, Hastings, MN (US); Douglas C. Sundet, Hudson, WI (US); Matthew S. Linabery, Roseville, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 969 days.

(21) Appl. No.: 11/419,668

(22) Filed: May 22, 2006

(65) Prior Publication Data

US 2006/0261525 A1 Nov. 23, 2006

Related U.S. Application Data

(60) Provisional application No. 60/683,643, filed on May 23, 2005.

(51) Int. Cl.
*B29C 47/26* (2006.01)

(52) U.S. Cl. ..... 264/555; 264/211.15; 264/905; 425/72.2; 425/382 R

(58) Field of Classification Search ..... 264/172.19, 264/211.14, 211.15, 211.17, 211.22, 514, 264/563, 905, 103, 555; 425/72.1, 72.2, 425/382 R See application file for complete search history.

(56) References Cited

U.S. PATENT DOCUMENTS

| | | | |
|---|---|---|---|
| 4,622,259 | A | 11/1986 | McAmish et al. |
| 4,846,102 | A | 7/1989 | Ozias |
| 4,854,263 | A | 8/1989 | Chang et al. |
| 5,044,315 | A | 9/1991 | Ozias |
| 5,244,694 | A | 9/1993 | Ozias |
| 5,405,446 | A | 4/1995 | Nakajima et al. |
| 5,441,568 | A | 8/1995 | Cho et al. |
| 5,474,102 | A | 12/1995 | Lopez |

(Continued)

FOREIGN PATENT DOCUMENTS

WO WO 99/32692 7/1999

(Continued)

OTHER PUBLICATIONS

Shambaugh, "A Macroscopic View of the Melt-Blowing Process for Producing Microfibers", *Ind. Eng. Chem. Res.*, 27, (1988), 2363-2372.

(Continued)

*Primary Examiner* — Joseph S Del Sole
*Assistant Examiner* — Ryan Ochylski
(74) *Attorney, Agent, or Firm* — Rick L. Franzen; James A. Baker

(57) ABSTRACT

Methods and apparatus for meltblowing utilize an auxiliary manifold to dispense a fluid between an orifice of a die that is expelling polymeric fibers and an exit of a duct that is dispensing a secondary flow of gas onto the fibers. The fluid dispensed from the auxiliary manifold reduces a recirculation zone of the secondary flow between the exit and the orifice that, absent the fluid from the manifold, results in errant fibers that are blown back into the face of the die by the recirculating secondary flow.

9 Claims, 10 Drawing Sheets

U.S. PATENT DOCUMENTS

| | | | | |
|---|---|---|---|---|
| 5,632,938 | A * | 5/1997 | Buehning, Sr. | 264/39 |
| 5,904,298 | A * | 5/1999 | Kwok et al. | 239/135 |
| 6,001,303 | A * | 12/1999 | Haynes et al. | 264/555 |
| 6,093,252 | A | 7/2000 | Wengert et al. | |
| 6,143,079 | A | 11/2000 | Halpin | |
| 6,185,839 | B1 | 2/2001 | Kholodenko et al. | |
| 6,495,078 | B1 * | 12/2002 | Kurihara et al. | 264/70 |
| 6,613,268 | B2 * | 9/2003 | Haynes et al. | 264/555 |
| 6,736,633 | B1 | 5/2004 | Dawson-Elli et al. | |
| 6,858,297 | B1 * | 2/2005 | Shah et al. | 428/401 |
| 6,861,025 | B2 | 3/2005 | Erickson et al. | |
| 6,896,475 | B2 | 5/2005 | Graziosi et al. | |
| 2001/0054234 | A1 | 12/2001 | Asta et al. | |
| 2002/0000310 | A1 | 1/2002 | Cheadle | |
| 2002/0125601 | A1 * | 9/2002 | Allen | 264/103 |
| 2002/0127293 | A1 * | 9/2002 | Bentley et al. | 425/72.2 |
| 2003/0006203 | A1 | 1/2003 | Romanyszyn et al. | |
| 2003/0056335 | A1 * | 3/2003 | Kurihara et al. | 19/299 |
| 2003/0173701 | A1 * | 9/2003 | Arseneau et al. | 264/210.8 |
| 2003/0234464 | A1 | 12/2003 | Erickson et al. | |
| 2004/0050326 | A1 | 3/2004 | Thilderkvist et al. | |
| 2005/0008728 | A1 * | 1/2005 | Wilkie et al. | 425/72.2 |
| 2005/0087767 | A1 | 4/2005 | Fitzgerald et al. | |
| 2005/0201896 | A1 | 9/2005 | Peck | |
| 2006/0049542 | A1 * | 3/2006 | Chu et al. | 264/211.22 |
| 2006/0246260 | A1 * | 11/2006 | Sundet et al. | 428/174 |

FOREIGN PATENT DOCUMENTS

| | | |
|---|---|---|
| WO | WO 00/22207 | 4/2000 |

OTHER PUBLICATIONS

Krutka et al., "Effects of Die Geometry on the Flow Field of the Melt-Blowing Process", *Ind. Eng. Chem. Res.*, 42, (2003), 5541-5553.

Marla et al., "Three-Dimensional Model of the Melt-Blowing Process", *Ind. Eng. Chem. Res.*, 42, (2003), 6993-7005.

Chen et al., "Air drawing of polymers in the melt blowing nonwoven process: mathematical modelling", *Modelling Simul. Mater. Sci. Eng.*, 12, (2004), 381-388.

Marla et al., "Modeling of the Melt Blowing Performance of Slot Dies", *Ind. Eng. Chem. Res.*, 43, (2004), 2789-2797.

Krutka et al., "Effects of Temperature and Geometry on the Flow Field of the Melt Blowing Process", *Ind. Eng. Chem. Res.*, 43, (2004), 4199-4210.

Koestel et al., "The Discharge of Air From a Long Slot", *Heating, Piping & Air Conditioning*, American Society of Heating and Ventilating Engineers Journal Section, Jan. 1948, pp. 153-157.

Koestel et al., "The Control of Air Streams from a Long Slot", *Heating, Piping & Air Conditioning,* The American Society of Heating and Ventilating Engineers Journal Section, Jul. 1951, pp. 111-115.

Mardon et al., "The Design of Manifold Systems for Paper Machine Headboxes, Part II—Taper Flow Manifolds", *Tappi*, vol. 46, No. 3, Mar. 1963, pp. 172-187.

Spengos et al., "Tapered Manifold Flow Spreader", *Tappi*, vol. 46, No. 3, Mar. 1963, pp. 195-200.

Madeley, "The tapered manifold as a flow distributor", *Paper Technology*, vol. 9, No. 1, 1968, pp. 35-39.

Mardon et al., "The Extant State of the Manifold Problem", Technical Paper T346, Pulp and Paper Magazine of Canada, vol. 72, No. 11, Nov. 1971, pp. 76-81.

Trufitt, "Design aspects of manifold-type flow spreaders", *Tappi*, vol. 58, No. 11, Nov. 1975, pp. 144-145.

Senecal, "Fluid Distribution in Process Equipment", Fluid Mechanics in Chemical Engineering, *Industrial and Engineering Chemistry*, vol. 49, No. 6, Jun. 1957, pp. 993-997.

* cited by examiner

METHODS AND APPARATUS FOR MELTBLOWING OF POLYMERIC MATERIAL UTILIZING FLUID FLOW FROM AN AUXILIARY MANIFOLD

CROSS REFERENCE TO RELATED APPLICATION

This application claims the benefit of U.S. Provisional Patent Application No. 60/683,643, filed May 23, 2005.

TECHNICAL FIELD

The present invention is related to meltblowing processes that produce non-woven polymeric materials. More particularly, the present invention is related to meltblowing while utilizing fluid flow from an auxiliary manifold in conjunction with ducts dispensing a secondary flow into the fiber emerging for the meltblowing die.

BACKGROUND

Nonwoven webs with useful properties can be formed using the meltblowing process in which filaments are extruded from a series of small orifices while being attenuated into fibers using hot air or other attenuating fluid. The attenuated fibers are formed into a web on a remotely-located collector or other suitable surface.

More recently, the literature in this field has described how secondary flows of fluid can be directed onto the fibers after they have been extruded from the orifices and attenuated, but before they have impacted on the collector. By manipulating the velocity and temperature of the secondary flows, the properties of the fibers, and thus the nonwoven web they form on the collector, can be modified in useful ways.

However, there are limitations to the use of secondary flows in this way. As the rate of fabric formation is increased, at a certain point the known techniques break down. The streams of attenuating fluid and the streams of secondary fluid begin to interact in unwanted ways as production rates increase. One particular failure mode that begins to manifest is the appearance of swirling recirculation zones downstream of the orifices. Some of the emerging fibers are swept into the recirculation zones and are swept off in unwanted directions, causing waste, reducing production, and fouling equipment. There has been an ongoing effort to improve the uniformity of nonwoven webs. The art desires a mechanism by which the advantages of a secondary flow for the fiber properties can be extended to the high production rates that reduce the costs of production.

SUMMARY

Embodiments of the present invention address these issues and others by providing methods and apparatus that reduce the recirculation zones to thereby decrease the amount of errant fibers fouling the die face. An auxiliary manifold dispenses fluid between the flow of quench gas and the orifice of the die. The fluid from the manifold reduces the area of low pressure, which thereby reduced the recirculation of quenching gas. As a result, the amount of errant fibers at the die face is also reduced.

One embodiment is a meltblowing apparatus having a die having a plurality of filament orifices for expelling polymeric material. At least one duct is positioned to direct a stream of gas towards the expelled polymeric material. The embodiment has at least one auxiliary manifold positioned relative to the die and the at least one duct such that a fluid is dispensed from the auxiliary manifold between the stream and the filament orifices to thereby substantially isolate the polymeric material from recirculation zones. Often enough in actual practice, two ducts will be provided, one on either side of the curtain of expelled polymer. In such cases, it is preferred to have two auxiliary manifolds, each positioned to isolate the polymeric material from its corresponding recirculation zone.

In preferred embodiments, the auxiliary manifold dispenses the fluid with a substantially uniform mass flow per unit length along the length of the positions of the filament orifices. In the detailed description below, guidance will be provided as to how to conveniently prepare a manifold dispensing substantially uniform mass flow, even when the fluid is compressible.

Another embodiment of the invention is a meltblowing apparatus having a die having a plurality of filament orifices for expelling polymeric material, the die expelling streams of polymeric material entrained in streams of air from a plurality of air knives within the die. At least one duct is positioned to direct a secondary flow of gas towards the expelled polymeric material and in a direction away from the die. Also at least one auxiliary manifold is positioned relative to the die and the at least one duct such that a fluid is dispensed from the auxiliary manifold into a location between the secondary flow and the streams of polymeric material and toward an area of recirculation zones of gas that is adjacent the die and with a mass flow rate less than the mass flow rate of the secondary flow to thereby substantially isolate the recirculation zones between the duct and the plurality of orifices.

Another aspect of the invention is a method of meltblowing, comprising:

expelling polymeric material from a plurality of filament orifices of a die;

directing a stream of gas towards the expelled polymeric material; and dispensing fluid from an auxiliary manifold, wherein the fluid is dispensed between the stream and the filament orifices to substantially isolate the polymeric material from areas of recirculation.

DETAILED DESCRIPTION

Embodiments of the present invention provide for a meltblowing apparatus which can treat the polymeric fibers emerging from the die with a controlled secondary flow so as to optimize the properties of the resulting nonwoven fabric, and it can do this even at high production rates. Techniques for planning the fabrication of suitable auxiliary manifolds will also be discussed.

Figure 1:
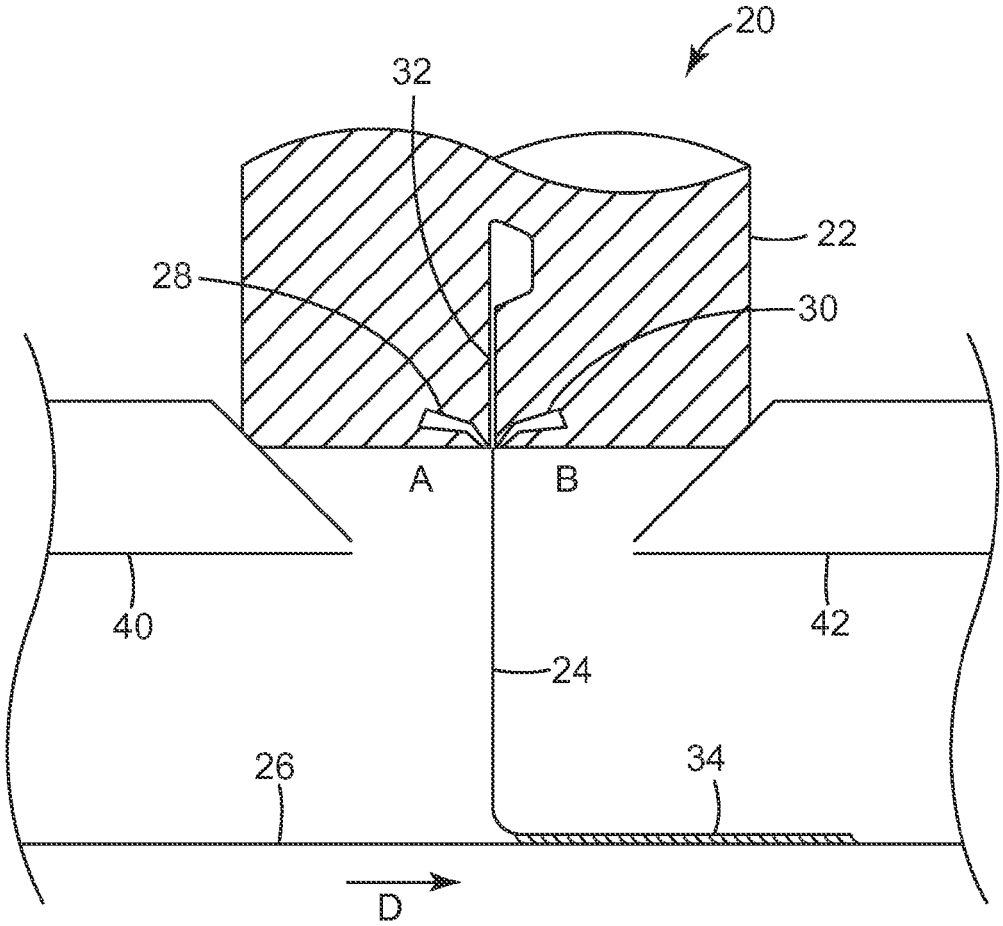
FIG. 1 PRIOR ART
FIG. 1 shows a cross-sectional view of a conventional meltblowing apparatus of the prior art that can develop large recirculation zones.

Referring now to FIG. 1, a cross-sectional view of a conventional meltblowing apparatus of the prior art that can develop large recirculation zones is illustrated. A meltblowing apparatus 20 including a meltblowing die 22 is illustrated in a representative cross-section. The meltblowing die 22 is used to expel a stream 24 of extended polymeric filaments towards a collection belt 26 moving in direction "D," is illustrated. According to conventional practice, the meltblowing die 22 is provided with cavities 28 and 30 for directing two streams of heated gas against the stream 24 just after the stream 24 has been extruded from a line of extrusion orifices 32. The heated gas jets emerging from cavities 28 and 30 to extend and thin the filaments emerging from the extrusion orifices 32 so that they have the proper size and dispersion to form the desired fabric 34 upon the collection belt 26. Although a belt is depicted in connection with this example, those acquainted with the meltblowing art will understand that a rotating drum can be used for the purposed of taking off the filaments as fabric.

The meltblowing apparatus 20 further includes a pair of ducts 40 and 42, one upstream and one downstream of the stream 24 compared to the direction "D". Secondary flow is expelled from ducts 40 and 42 against the filament stream 24 so the filaments, when they impinge upon the collection belt 26, have the properties desired in the fabric 34.

The foregoing description generally follows the disclosure of U.S. Pat. No. 6,861,025 to Breister et al, and is adequate for the production of meltblown fabrics at low and moderate speeds of collection belt 26. However, as the process is run harder and faster, e.g. after the production of fabric exceeds approximately 35 g/hour/hole, difficulties arise in the form of erratic motion imparted to some of the emerging filaments. At higher extrusion rates, the orderly accumulation of filaments upon collection belt 26 becomes disrupted, and some filaments begin to collect upon the surface of die 22 and on the ducts 40 and 42. This observation suggests that paired areas of recirculation, taking the form of standing vortices had formed roughly at the positions marked A and B.

In that it is desirable to be able to increase line speed while maintaining the desirable properties of the fabric 34, and in that disrupting the posited recirculation zones A and B seem likely to be amenable to solution by a gas-dispensing manifold that is elongated in the direction perpendicular to the two-dimensional representation of FIG. 1.

Figure 2:
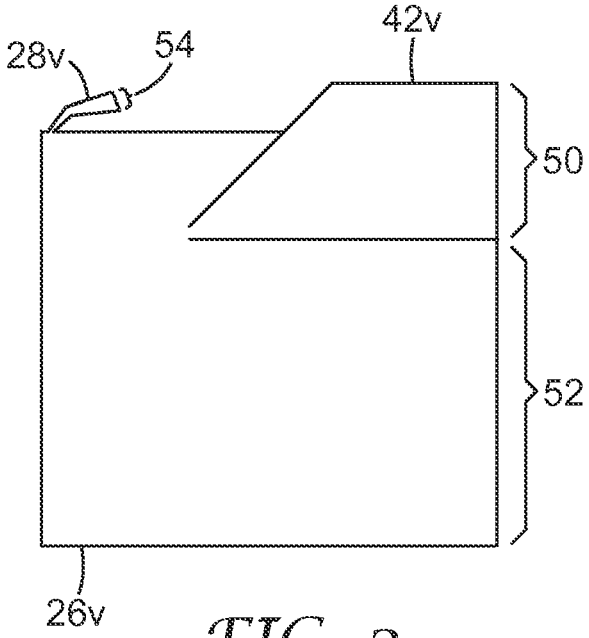
FIG. 2 shows the two-dimensional geometrical representation of a cross-section of a meltblowing apparatus utilized in designing an auxiliary manifold.

An initial geometrical representation was set up according to FIG. 2. A simplifying assumption was made that the problem was symmetrical in spite of the recognized complication that the collection belt (26 in FIG. 1) is in motion and does generate some fluid motion by the no-slip condition. The existing geometry of the cavity (28 in FIG. 1), the duct (42 in FIG. 1) and collection belt (26 in FIG. 1), are represented virtually as geometric representations 28*v*, 42*v*, and 26*v*, respectively. Boundary conditions are set as being the known gas pressures that provide the best, albeit inadequate, operating conditions when collection belt 26 is operated at high line speed. In the geometrical representation, those pressures are assumed to exist uniformly along lines 50, 52, and 54.

Figure 3:
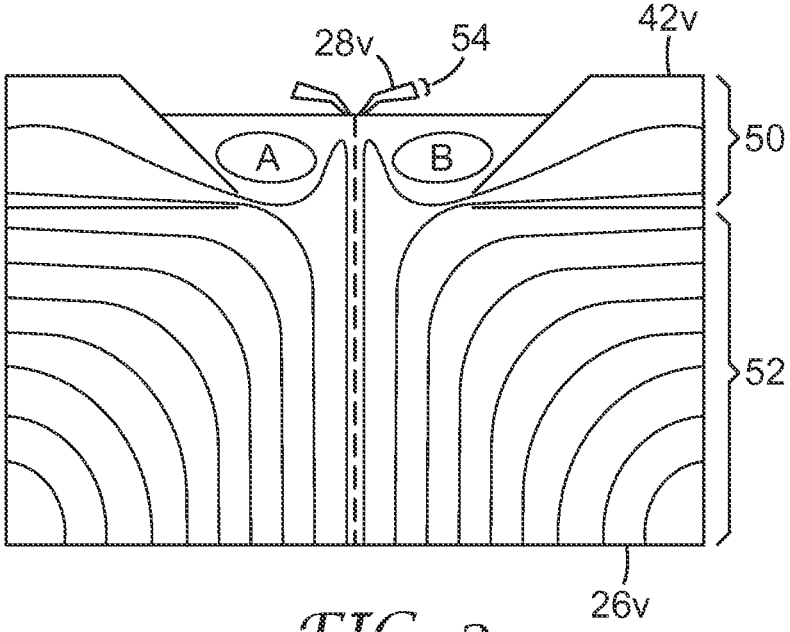
FIG. 3 shows the geometrical representation of FIG. 2 after having been meshed into finite elements allowing for modeling of streamlines to be utilized in designing the auxiliary manifold.

This two-dimensional geometry and these boundary conditions are provided to a commercially available flow analysis package to determine the presence of the recirculation zones in preparation for adding an auxiliary manifold and determining what the desired mass profile should be to adequately isolate the recirculation zones. Although a number of commercial offerings are considered suitable, the FLUENT solver, commercially available from Fluent, Inc. of Lebanon, N.H., may be used. The k-epsilon two-equation model is selected for this problem, and the use of renormalized groups is enabled. The function taking viscous heating of the gas is also enabled. Once the described geometry and boundary conditions are in place, and the space defined in FIG. 2 has been meshed into finite elements, the solver is run in a manner so as to visualize the streamlines representing gas flow after an equilibrium condition has established itself. These streamlines are illustrated in FIG. 3. In this figure, the hypothesis that recirculation zones at A and B are formed is strengthened by the appearance of the closed streamlines around those locations.

Figure 4:
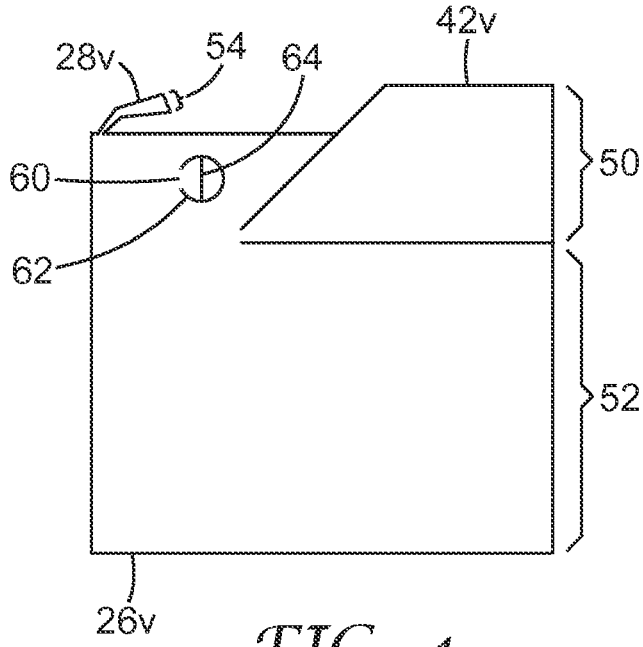
FIG. 4 shows the geometrical representation of FIG. 2 after having an auxiliary manifold added.

In this example, it is believed that the recirculation zones may be disrupted by an additional flow of gas emerging from an aperture 60 in a new manifold 62 as shown in FIG. 4. As is true for the rest of the geometry, the gas-dispensing manifold 62 is posited to be elongated in the direction perpendicular to the two-dimensional representation of FIG. 1, and that any given cross-section is representative of the flow at any other cross-section taken along that perpendicular. For simplicity, a boundary condition line 64 is established within the manifold 62, at this stage it is presumed that a uniform pressure can be maintained uniformly along line 64 at every possible cross-section. Later in the design process, this simplifying assumption may be verified and addressed as necessary.

As a starting point for this particular example, it is assumed that the mass flow emerging from manifold 62 to disrupt the recirculation zones should be 50% of the mass flow known to be needed from the duct 42 in order to achieve the needed treatment of the filaments at the desired production rate (over 35 g/hour/hole being sought). As another starting point, the pressure along boundary condition line 64 is arbitrarily set at some reasonable value, such as 20 psig total, merely from being a reasonable fraction of the static pressure capacity of a readily available compressor. A starting size for aperture 60 is derived by simple orifice equations from the assumed mass flow needed from manifold 62 at the assumed pressure within manifold 62.

Figure 5:
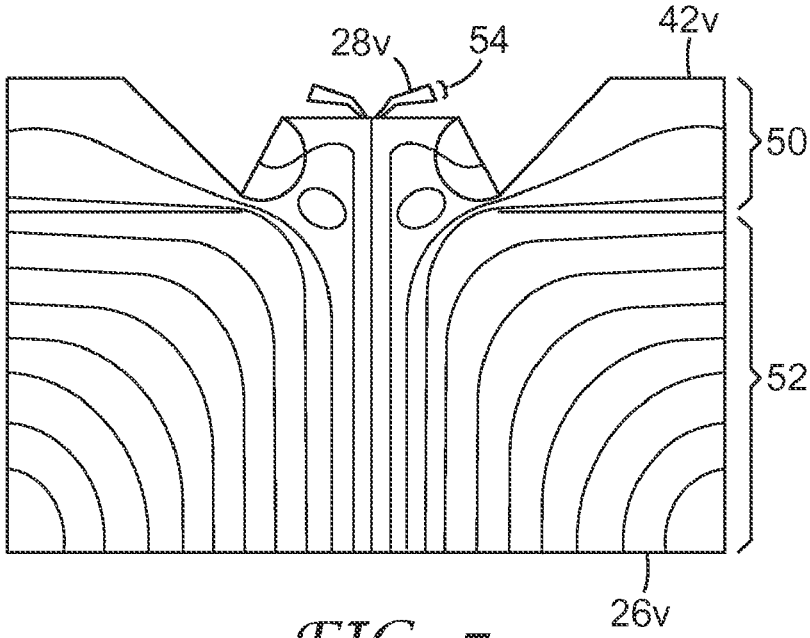
FIG. 5 shows the geometrical representation of FIG. 4 after having been meshed into finite elements allowing for modeling of streamlines that result from the introduction of the auxiliary manifold.

With these assumptions in place, the solver is again employed to analyze the new geometry and boundary conditions. For this example, a number of trials may be run varying the position of aperture 60 around the circumference of manifold 62. Analysis of the streamlines produced by the trials suggested that best results would be achieved not by aiming the outflow from manifold 62 at the center of recirculation zone B, but in front of it so as to create a curtainwall of moving gas to isolate the emerging filaments from the recirculation zone. This condition is illustrated in FIG. 5, and at this point it can be said that a dispensing direction has been determined for the manifold 62 to go along with the mass flow rate previously assumed for the given input pressure. It is further assumed for this example that the distribution of flow over the elongated length of the manifold in the third dimension should be uniform to properly isolate the recirculation zones.

Once the best direction for aiming the outflow of manifold 62 are determined for this particular example, an additional group of trials with the solver are performed in order to determine whether the assumed mass flow from manifold 62 can be reduced while still maintaining isolation of the recirculation zones in order to save energy costs in providing that flow. In these experiments for this particular example, it has been found that the mass flow may be reduced to 30% of the mass flow emerging from the duct before the flow from the manifold can no longer isolate the stream of filaments 24 from the recirculation zone.

Figure 6:
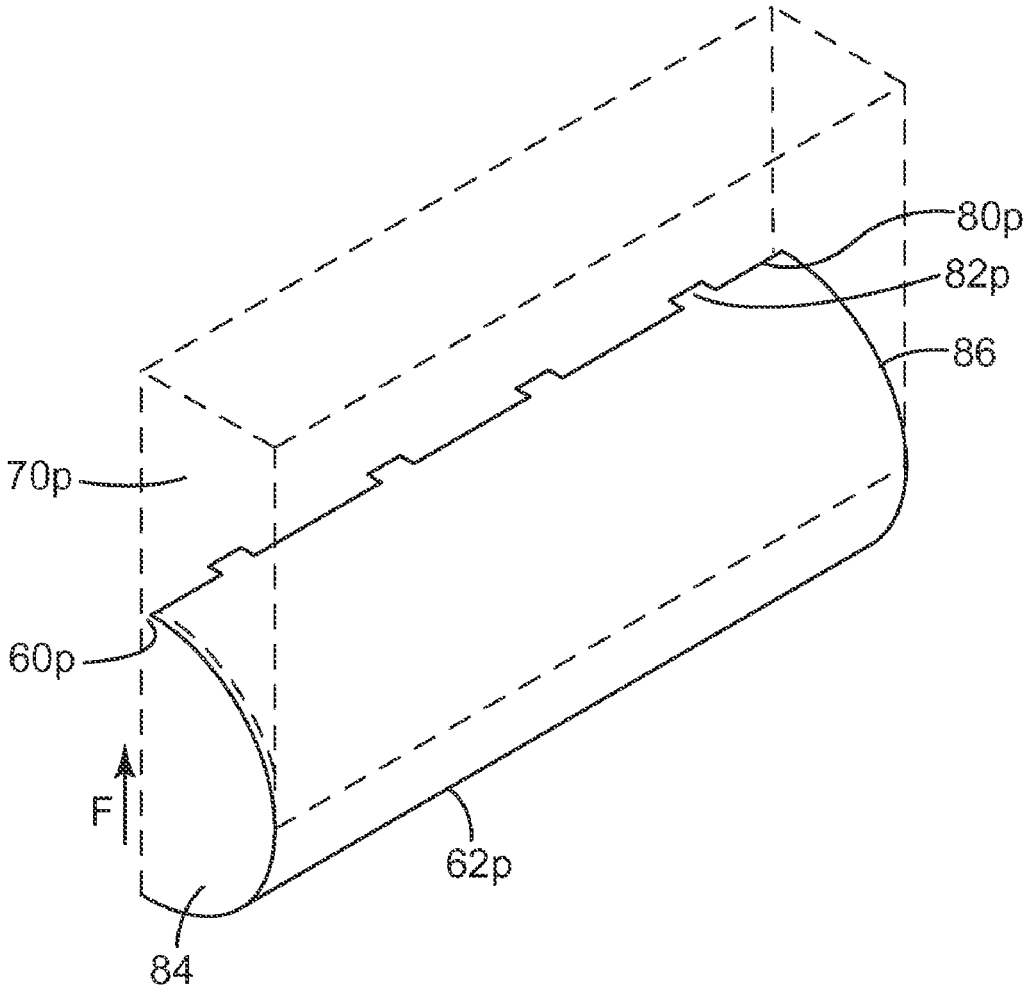
FIG. 6 shows a three-dimensional geometrical representation of the auxiliary manifold having the conditions defined by the two-dimensional geometrical representation of meshed elements shown in FIG. 5.

By this point, a viable solution to the practical problem needing resolution has been achieved, i.e., the desired mass flow profile, provided it turns out to be possible to provide the identified mass flow appropriately along the elongated length of the manifold 62 in the direction perpendicular to the two-dimensional representation. The previously made simplifying assumption that this would turn out to be possible still must be verified. In order to carry out this challenge, a 3-D mathematical representation 9 of the gas inside the manifold 62 and in its immediate environs is created. In this representation, the geometry of the manifold 62*p* is essentially inverse, defining a boundary across which the gas cannot flow. This geometrical representation is illustrated in FIG. 6. In this Figure, one-half of manifold 62 has been converted to this virtual representation 62*p*, because the simplifying assumption has been made that the situation is symmetrical. Also included in the representation is the solution domain 70*p* of the exhausted gas emanating from the virtual representation of the manifold 62*p*. Although it may not be intuitively obvious that the volume of gas adjacent to the outside surface of manifold 62*p* so far around the circumference from the slots 80*p* need to be included in the 3-D mathematical representation, intuition is incorrect. Not including this seemingly extra volume in the 3-D mathematical representation often causes invalid results.

The representation of the manifold 62*p* may be designed while recognizing that it may be necessary to increase structural strength by providing the aperture 60*p* as a series of slots 80*p* separated by bridges 82*p*. Other geometries for the apertures 60*p* are possible, of course, and are considered within the scope of the invention. In the instant description, a cylindrical tube of 51 mm in outside diameter, 45 mm inside diameter, and 188 cm long (a relatively lengthy manifold compared to the trial and error manifolds of the prior art that are typically much shorter than 60 cm) was selected as a starting point for manifold 62 by reason of such a size being conveniently positionable in the meltblowing apparatus 20. As a starting point for the analysis for this particular example, it was assumed that the tube would be provided with slots 38 mm long and 3.2 mm wide, separated one from the next by 3.2 mm by bridges in accordance with the orifices of the meltblowing apparatus of interest. A rule of thumb is to maintain the total surface area of the exits to an amount that is no more than the total area of the inlet of the manifold.

The gas volume within and adjacent to the exterior of the inverse representation of the manifold 62*p* is then meshed into finite hexahedral elements such that at least some of the hexahedral elements are oriented relative to the dispensing direction, depicted as "F" in this Figure. As a boundary condition, the manifold 62*p* is assumed to be filled from one end 84, or both ends 84 and 86. More specifically, the mass flow in, e.g. kg/sec/m that provided isolation of the recirculation zones in the 2D representation is multiplied by the length of the manifold 62*p*. Then the entry of one half of that total mass flow (because the assumption is being made that the other half to the total mass flow is being handled by the symmetrical other half of the manifold) into the representation through the surface of end 84, or end 84 and end 86, is set as a boundary condition.

Figure 7:
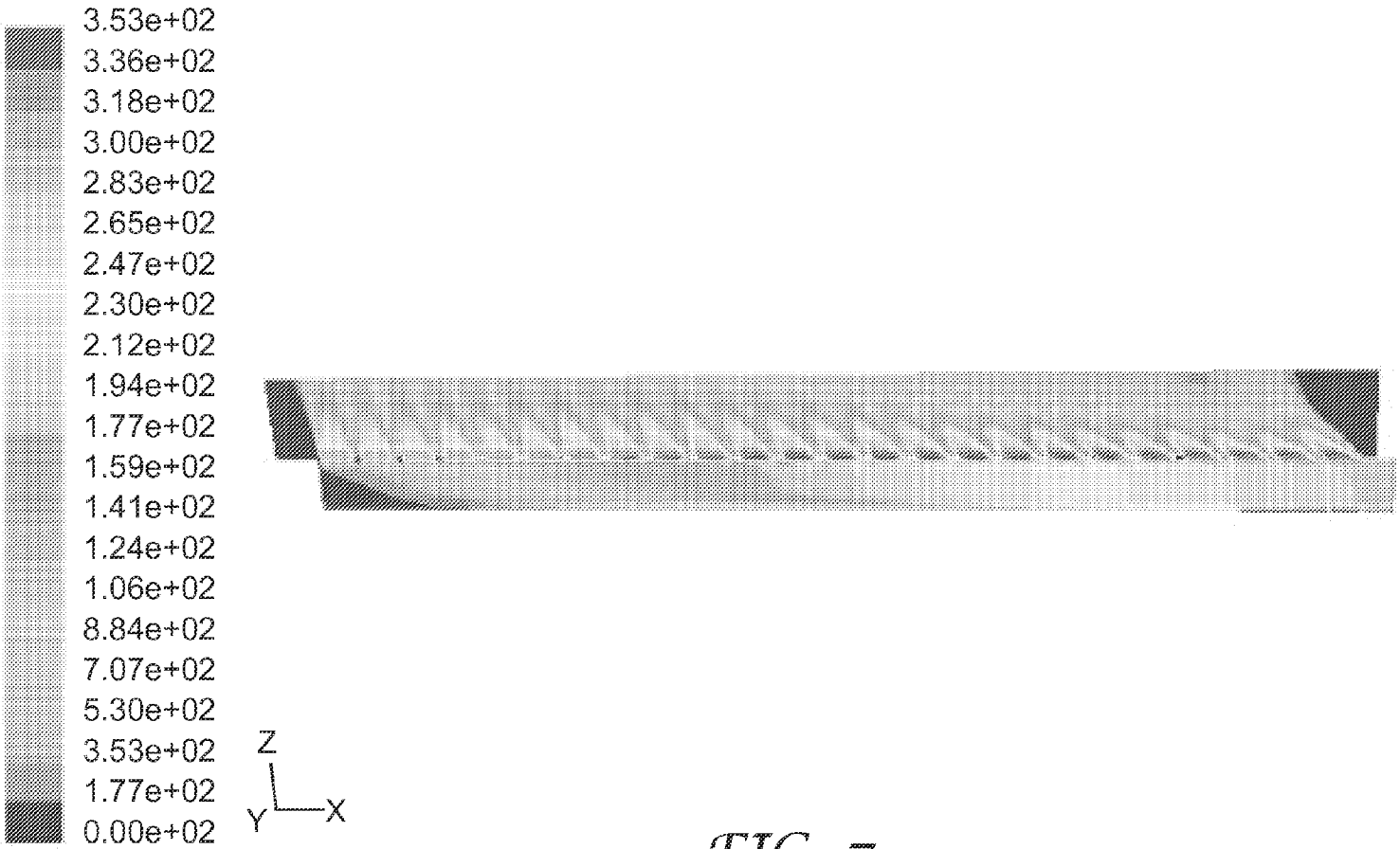
FIG. 7 shows the distribution of mass flow and direction over the third dimension of the auxiliary manifold after an initial attempt of design within the geometrical representation of FIG. 6 that has resulted in a non-uniform distribution and non-perpendicular direction of flow.

This three-dimensional geometry and these boundary conditions are provided again to the FLUENT solver, and once again the k-epsilon two-equation model is employed. Also, the use of renormalized groups, and (because the fluid in the instant example is compressible air) the function taking viscous heating of the gas into account are also enabled. The solver is then run so as to provide the vector and the magnitude of the velocity of the fluid at various points. This vector field was used to prepare a false color visualization of the velocity of the fluid passing through each slot in the dispensing direction, so as to by derivation provide an indication of the actual distribution of mass flow over the elongated length of the manifold. This is illustrated as FIG. 7, where the gas is entering the manifold from one end in flow direction "F". It can be observed from the Figure that the flow is not uniform along the elongated length of the manifold such that the trial geometrical parameters have failed to yield the desired mass flow profile.

According to embodiments of the present invention, if an analysis of these trial geometrical parameters of slot length, slot width, slot spacing, manifold diameter, etc., fails to describe the delivery of the needed mass flow from the manifold in a fashion sufficiently the same as is desired, it is needful to refine these geometrical parameters, and rerun the analysis. It has been found that reducing the ratio of the combined outlet area to the combined inlet area tends to make the flow more uniformly distributed, should uniform flow over the elongated length of the manifold be desired for a particular application. In the present example, when the visualization of FIG. 7 demonstrates that the flow from the 6.4 mm wide slots was insufficiently uniform, the geometrical parameters of the 3-D model are adjusted to 1.59 mm wide and the model is once again put to the solver. The solver is again run so as to provide a visualization of the velocity of the fluid passing through each of these narrower slots in the dispensing direction. This is illustrated as FIG. 8, and it can be observed from the Figure that the velocity, and by derivation the mass flow profile, has a much more uniform distribution of flow along the elongated length of the manifold than was the case in FIG. 7. For this particular example, the uniformity of the flow profile is considered to be sufficiently good to generate an even curtainwall of gas flow to isolate the filaments from the recirculation zones across an entire production web.

Figure 8:
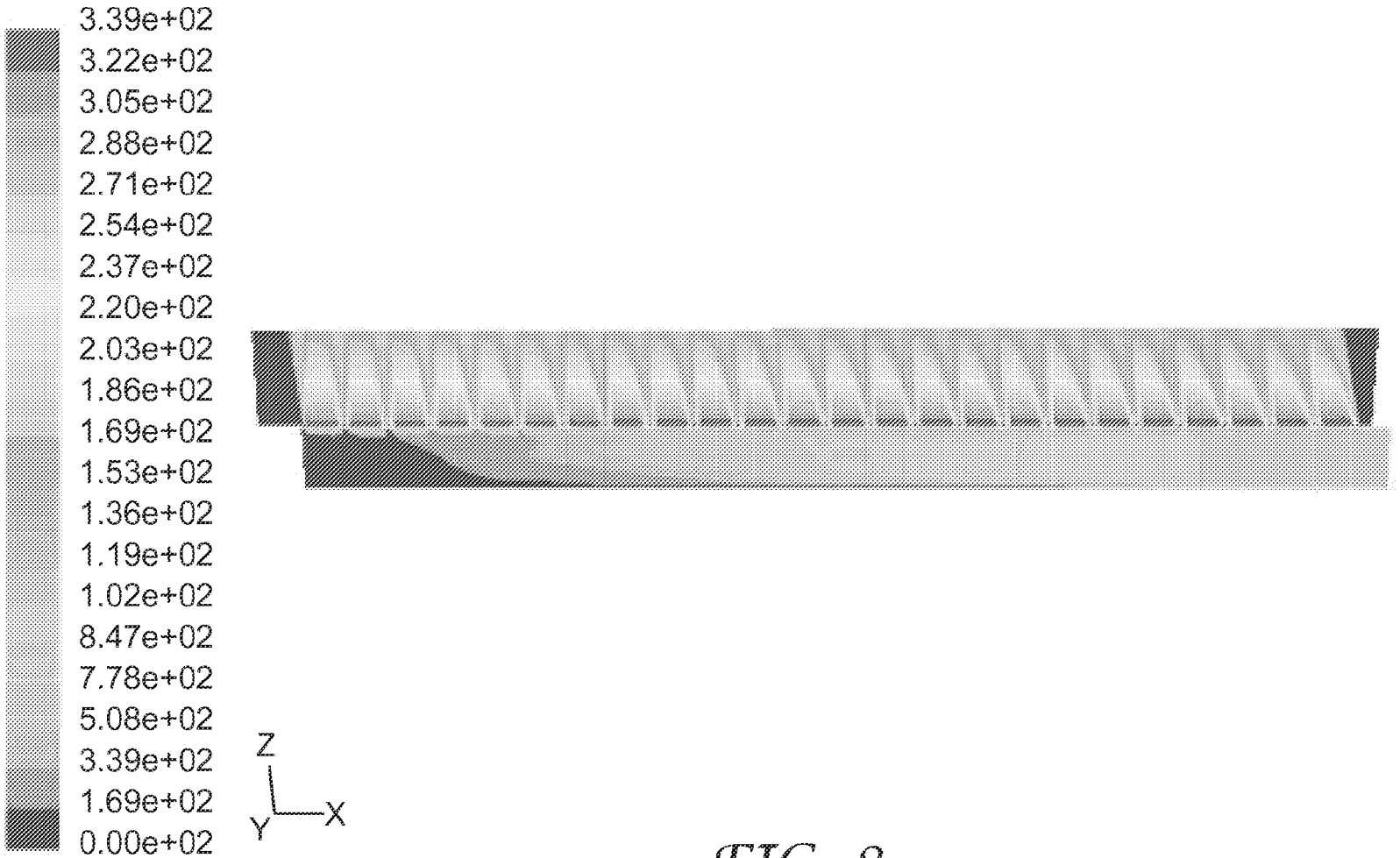
FIG. 8 shows the distribution of mass flow and direction over the third dimension of the auxiliary manifold after a subsequent attempt of design within the geometrical representation of FIG. 6 that has resulted in a substantially uniform distribution and a substantially perpendicular direction of flow.
Figure 9A:
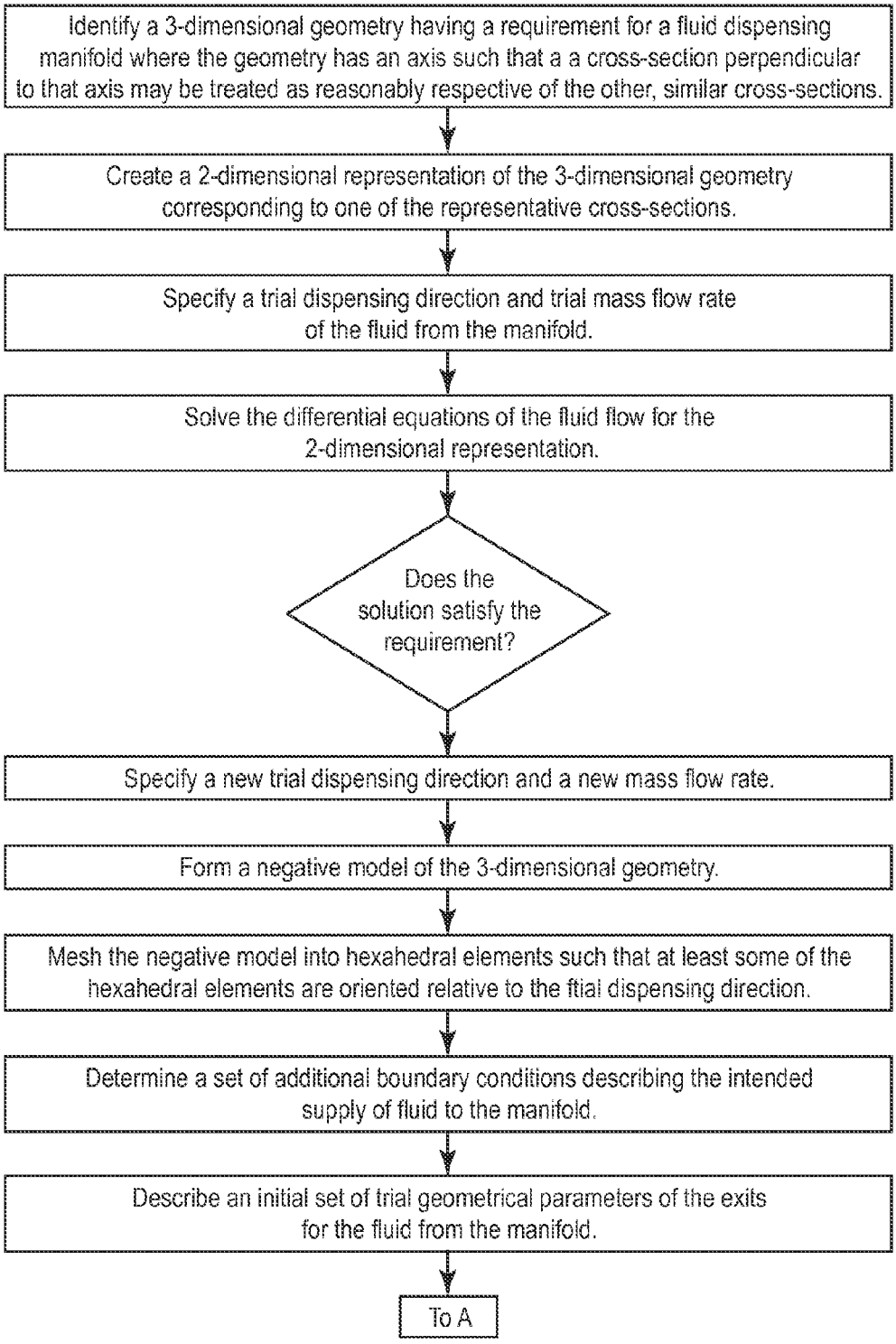
FIGS. 9A-9D shows a flowchart illustrating an example embodiment of a method of designing a manifold.
Figure 9B:
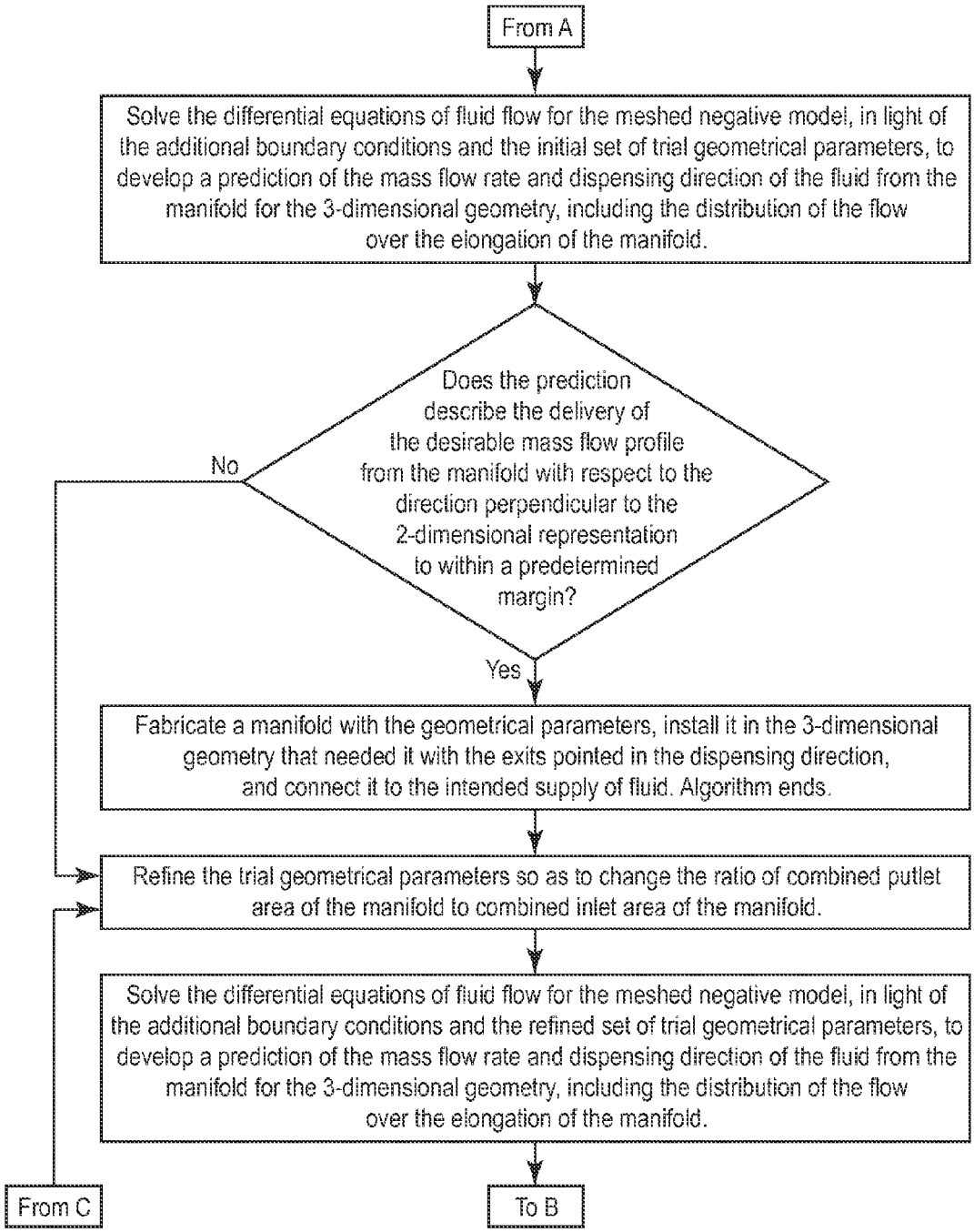
Figure 9C:
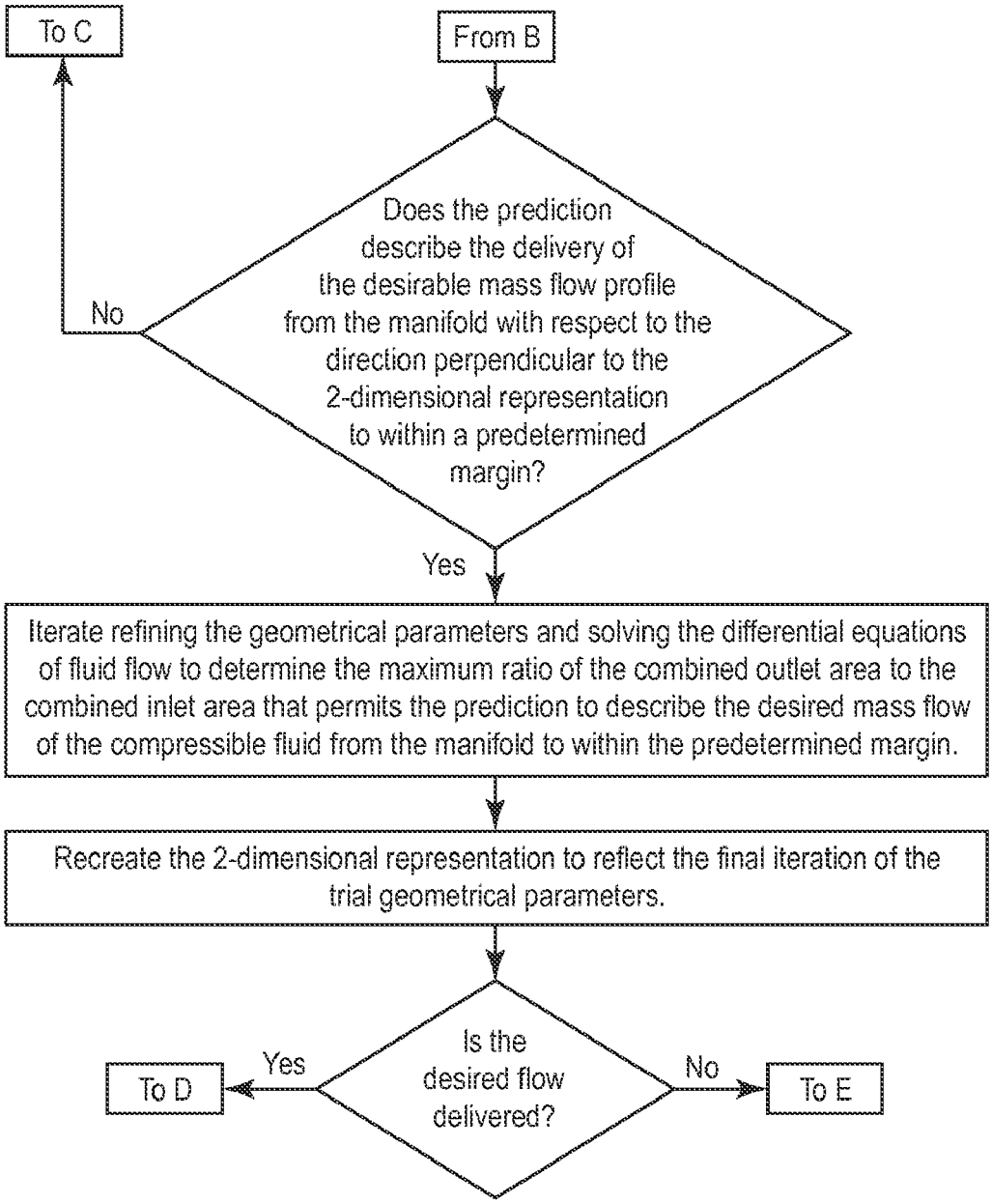
Figure 9D:
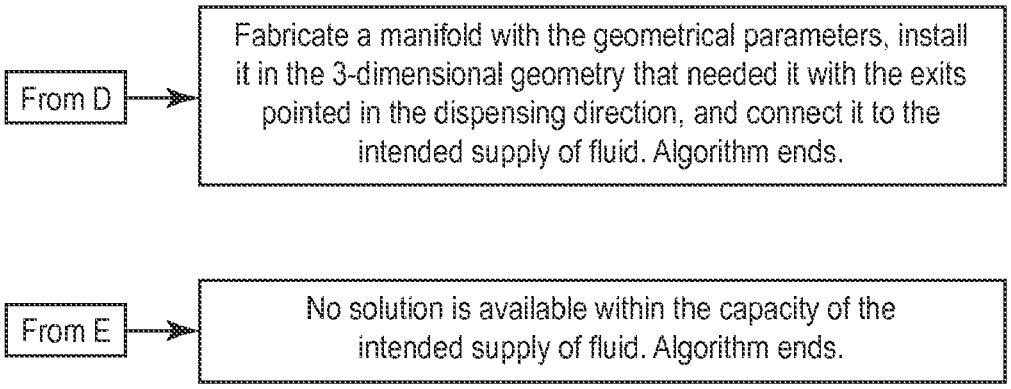

To test this estimate for this particular meltblowing situation, a real manifold was fabricated from metal according to the parameters that generated FIG. 8, and this manifold was installed in a meltblowing line according to the direction and positions identified in the 2-D analysis as illustrated in FIG. 4. The manifold was pressurized to 20 psig total at both ends, and fabric was made. It was observed that the unwanted accumulation of filaments on the surface of the die and the ducts is arrested, and the properties of the fabric were not adversely affected.

A caveat is appropriate to note concerning the step of reducing the ratio of the combined outlet area to the combined inlet area of the manifold when needful to achieve the necessary degree of uniformity of output along the length of the manifold. Heedlessly reducing the ratio more than necessary tends to give rise to other difficulties, particularly difficulties related to the amount of pressure needed to drive the mass flow. Higher pressures are more costly to achieve with respect to providing a suitable compressor to supply the manifold 62, and higher pressures may require that the manifold 62 be constructed out of more expensive materials in order to withstand the stresses of pressurization.

In fact, in some circumstances it may prove difficult in iterating the geometrical parameters in the three-dimensional model so as to achieve the target mass flow rate, and the target distribution of flow along the length of the manifold, within the limitations of the equipment one hoped to use. When this has occurred, an optional step may be performed. The maximum mass flow rate the desirable equipment can provide with the needed level of uniformity along the length of the manifold is noted, and the 2-dimensional representation is reconstructed with that level of mass flow rate. Then the parameters of the exact position and dispensing direction of the manifold can be iterated and reanalyzed, seeking a combination where the manifold's maximum output of mass flow while retaining the target distribution of flow is sufficient to achieve the goal previously set for the desired mass flow profile, e.g. in the present example the isolation of the recirculation zone. It will be understood that it will sometimes be impossible to achieve some mass flow profiles involving combinations of mass flow and distribution of flow for some combinations of manifold geometry and gas supply equipment. It will further be understood that some configurations that the method allows as being suitable for the desired dispensing will be unsuitable for having sufficient structural strength for containing the internal pressure or for spanning the distance between supports when emplaced. It is contemplated that requirements for suction manifolds that evacuate, rather than dispense fluid, are suitable for treatment by the method of the present invention.

While the invention has been particularly shown and described with reference to various embodiments thereof, it will be understood by those skilled in the art that various other changes in the form and details may be made therein without departing from the spirit and scope of the invention.

What is claimed is:

1. A meltblowing apparatus, comprising:

a die having a plurality of filament orifices for expelling polymeric material and a plurality of air knives within the die;

at least one duct positioned to direct a secondary stream of gas towards the expelled polymeric material; and at least one auxiliary manifold positioned below said plurality of air knives and relative to the die and the at least one duct such that a tertiary stream of fluid controlled separately from the secondary stream of gas is dispensed from the auxiliary manifold between the stream of gas and the filament orifices at a mass flow rate less than a mass flow rate of the secondary stream of gas to thereby substantially isolate the polymeric material from recirculation zones.

2. The meltblowing apparatus of claim 1 wherein the auxiliary manifold dispenses the fluid with a substantially uniform mass flow per unit length along the length of the positions of the filament orifices.

3. The meltblowing apparatus of claim 1, wherein the fluid is compressible.

4. A method of meltblowing, comprising:

expelling polymeric material from a plurality of filament orifices of a die, entrained in streams of air from a plurality of air knives within the die;

directing a stream of secondary gas from a duct towards the expelled polymeric material; and dispensing a tertiary stream of fluid controlled separately from the stream of secondary gas from an auxiliary manifold positioned below said plurality of air knives and relative to the die and the at least one duct, wherein the tertiary stream of fluid is dispensed between the stream of secondary gas and the filament orifices at a mass flow rate less than a mass flow rate of the stream of secondary gas to substantially isolate the polymeric material from areas of recirculation.

5. The method of claim 4, wherein dispensing fluid from the auxiliary manifold comprises dispensing fluid having a substantially uniform mass flow per unit length along the length of the positions of the filament orifices.

6. The method of claim 5, wherein dispensing fluid from the auxiliary manifold comprises dispensing fluid that is compressible.

7. A meltblowing apparatus, comprising:

a die having a plurality of filament orifices for expelling polymeric material, the die expelling streams of polymeric material entrained in streams of air from a plurality of air knives within the die;

at least one duct positioned to direct a secondary flow of gas towards the expelled polymeric material and in a direction away from the die; and at least one auxiliary manifold positioned below said plurality of air knives and relative to the die and the at least one duct such that a tertiary flow of fluid controlled separately from the stream of secondary gas is dispensed from the auxiliary manifold into a location between the secondary flow and the streams of polymeric material and toward an area of recirculation zones of gas that is adjacent the die, wherein the tertiary flow of fluid is controlled separately from the secondary flow of gas to provide a mass flow rate less than a mass flow rate of the secondary flow of gas to thereby substantially isolate the recirculation zones between the duct and the plurality of orifices.

8. The meltblowing apparatus of claim 7 wherein the auxiliary manifold dispenses the fluid with a substantially uniform mass flow per unit length along the length of the positions of the filament orifices.

9. The meltblowing apparatus of claim 8, wherein the fluid is compressible.

* * * * *